US006550821B2

(12) United States Patent
DeLange et al.

(10) Patent No.: US 6,550,821 B2
(45) Date of Patent: Apr. 22, 2003

(54) THREADED CONNECTION

(75) Inventors: Richard W. DeLange, Kingwood, TX (US); M. Edward Evans, Spring, TX (US)

(73) Assignee: Grant Prideco, L.P., The Woodlands, TX (US)

( * ) Notice: Subject to any disclaimer, the term of this patent is extended or adjusted under 35 U.S.C. 154(b) by 0 days.

(21) Appl. No.: 09/811,734

(22) Filed: Mar. 19, 2001

(65) Prior Publication Data

US 2002/0130517 A1 Sep. 19, 2002

(51) Int. Cl.[7] ..... F16L 25/00; F16L 35/00

(52) U.S. Cl. ..... 285/333; 285/332.4; 285/332; 285/390; 285/355

(58) Field of Search ..... 285/333, 334, 285/390, 355, 350

(56) References Cited

U.S. PATENT DOCUMENTS

| | | | | |
|---|---|---|---|---|
| 2,827,313 | A | | 3/1958 | Conner |
| 3,467,413 | A | | 9/1969 | Madrelle |
| 4,009,893 | A | | 3/1977 | Schatton et al. |
| 4,161,332 | A | | 7/1979 | Blose |
| 4,192,533 | A | | 3/1980 | Blose |
| 4,521,042 | A | | 6/1985 | Blackburn et al. |
| 4,570,892 | A | | 2/1986 | Blose et al. |
| 4,577,895 | A | | 3/1986 | Castille |
| 4,598,455 | A | | 7/1986 | Morris |
| 4,611,838 | A | | 9/1986 | Heilmann et al. |
| 4,629,221 | A | | 12/1986 | Lumsden et al. |
| 4,662,659 | A | | 5/1987 | Blose et al. |
| 4,671,544 | A | | 6/1987 | Ortloff |
| 4,676,529 | A | | 6/1987 | McDonald |
| 4,688,832 | A | | 8/1987 | Ortloff et al. |
| 4,696,498 | A | | 9/1987 | Church |
| 4,705,307 | A | | 11/1987 | Chelette |
| 4,736,967 | A | | 4/1988 | Mott et al. |
| 4,753,460 | A | | 6/1988 | Tung |
| 4,795,200 | A | | 1/1989 | Tung |
| 4,830,411 | A | | 5/1989 | Tsuru et al. |
| 4,893,844 | A | | 1/1990 | Chelette et al. |
| 4,928,999 | A | | 5/1990 | Landriault et al. |
| 4,946,201 | A | | 8/1990 | Tai |
| 4,988,127 | A | | 1/1991 | Cartensen |
| 5,029,906 | A | | 7/1991 | Chelette et al. |
| 5,064,224 | A | | 11/1991 | Tai |
| 5,154,452 | A | | 10/1992 | Johnson |
| RE34,467 | E | * | 12/1993 | Reeves ..... 285/334 |
| 5,348,095 | A | | 9/1994 | Worrall et al. |
| 5,415,442 | A | | 5/1995 | Klementich |
| 5,423,579 | A | | 6/1995 | Blose et al. |
| 5,462,315 | A | | 10/1995 | Klementich |
| 5,649,725 | A | | 7/1997 | Nagasaku et al. |
| 5,687,999 | A | | 11/1997 | Lancry et al. |
| 5,709,416 | A | | 1/1998 | Wood |
| 5,765,836 | A | | 6/1998 | Banker et al. |
| 5,971,443 | A | | 10/1999 | Noel et al. |
| 6,254,146 | B1 | * | 7/2001 | Church ..... 285/334 |

* cited by examiner

*Primary Examiner*—Eric K. Nicholson
*Assistant Examiner*—Aaron M Dunwoody
(74) *Attorney, Agent, or Firm*—Browning Bushman P.C.

(57) ABSTRACT

A threaded connection for tubular members comprising a box connector having axially spaced threaded sections and a thread-free section therebetween, the threaded sections of the box connector defining a two-step thread, a pin connector having axially spaced threaded sections and a thread-free section therebetween, the threads in the box connector mating with the threads on the pin connector, there being at least one annular relief in the thread-free portion of at least one of the pin connector and the box connector, an axially facing pin torque shoulder being formed on the pin connector and an axially facing box torque shoulder being formed on the box connector, a metal-to-metal seal being formed between the thread-free sections of the pin and box connectors when the pin torque shoulder and the box torque shoulder are engaged, the annular relief being adjacent the metal-to-metal seal.

22 Claims, 5 Drawing Sheets

17
17a
16
26
22
32
24
A
34
30
36
28
20
12
11
14
10
18
19a
19

48
46
26
22
24
34
32
30
36
42
28
20
40
44

THREADED CONNECTION

BACKGROUND OF THE INVENTION

1. Field of the Invention

The present invention relates to threaded connections for use in connecting tubular members and, more particularly, threaded connections used in casing strings and other pipe strings that can be expanded radially to an increased internal diameter.

2. Description of the Prior Art

In U.S. Pat. No. 5,348,095, there is disclosed an apparatus and method for radially expanding well casing after the casing string has been lowered into a well bore. Expansion of the casing string is accomplished by moving an oversized forging tool, or "pig," through the string. The technique permits subsequent strings of casing to be lowered through the previously enlarged casing string sections and thereafter similarly expanded. The result is a well cased by a series of linked sections of casing having substantially the same internal diameters.

Conventional casing strings are made up of a series of individual pipe joints secured together at their ends by threaded connections. Typically, a joint of casing is approximately 40 feet in length and has a threaded male, or pin, connection at one end and a threaded female, or box, connection at the other end. However, the joint may have a pin at each end, successive joints being made up by means of a coupling that has a box at each end to receive the pins on the adjacent joints of coupling. In the other case, the box connection is integrally formed at one end of the casing joint. These integral box connections can be of a larger OD than the OD of the pipe body, or they can have an OD the same size as the OD of the pipe body, the latter case being referred to as a "flush joint connection."

Obviously, one of the problems in expanding casing strings is to ensure that the threaded connections retain their integrity after the expansion process. More particularly, in many cases, it is desired that the casing string be expanded by up to 25% and still maintain a gas-tight seal at the threaded connections. While this can be accomplished with various thread designs, the use of resilient O-rings or other resilient seal rings, it is clearly desirable if a metal-to-metal gas-tight seal can be maintained after the expansion process.

Over and above expandable casing strings, there still remains a need for conventional casing strings that will maintain a metal-to-metal gas-tight seal, even under high bending loads.

SUMMARY OF THE INVENTION

It is therefore an object of the present invention to provide a threaded connection for tubular members, such as casing strings.

Another object of the present invention is to provide a threaded connection that concentrates the metal-to-metal sealing between the pin and box connectors at a point of enhanced radial wall thickness.

Still a further object of the present invention is to provide a threaded connection having a gas-tight seal in which the threads can be run out or extend substantially to the axially outermost end of the pin connector and the axially innermost end of the box connector.

Still a further object of the present invention is to provide a threaded connection for tubular members having a gas-tight seal that is maintained upon radially expanding the tubular members by up to 130% of its original diameter.

The above and other objects of the present invention will become apparent from the drawings, the description given herein, and the appended claims.

In accordance with the present invention, there is provided a threaded connection for tubular members that includes a box connector and a pin connector. The box connector has an axially inner, internally threaded section; an axially outer, internally threaded section; and a thread-free section between the inner and outer internally threaded sections. The axially inner and axially outer threaded sections in the box connector form a two-step thread; i.e., a step is formed between the inner internally threaded section and the outer internally threaded section. The pin connector has an axially inner, externally threaded section; an axially outer, externally threaded section; and a thread-free section between the inner and outer externally threaded sections. The threaded sections on the pin connector are also stepped and mate with the threaded sections on the box connector. The mating threads of the pin and box connectors can be of virtually any form. The threaded connection further includes at least one annular relief in the thread-free section of at least one of the pin and box connectors. An axially facing, annularly extending pin torque shoulder is fonned on the pin connector, while an axially facing, annularly extending box torque shoulder is formed in the box connector. A metal-to-metal seal is formed between the thread-free portions of the box connector and the pin connector when the pin torque shoulder and the box torque shoulder are engaged, the annular relief being adjacent and on either side of the metal-to-metal seal.

DESCRIPTION OF THE PREFERRED EMBODIMENTS

Figure 1:
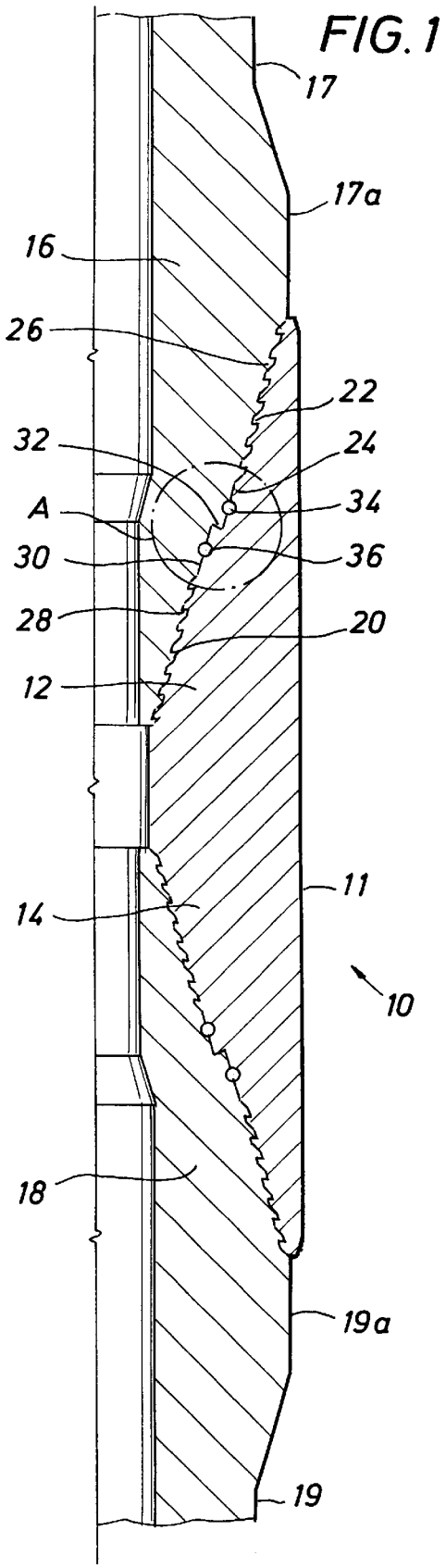
FIG. 1 is a quarter, cross-sectional view of one embodiment of the threaded connection of the present invention.

With reference first to FIG. 1, a threaded connection of the present invention, shown generally as 10, includes a coupling 11 forming a first box connector 12 and a second box connector 14 in which are received threaded pin connectors 16 and 18, respectively. As seen, pin connectors 16, 18 are formed on end portions 17*a*, 19*a* of tubular members 17, 19, respectively, end portions 17*a*, 19*a* having increased wall thickness relative to the wall thickness of tubular members 17, 19, respectively. For purposes of brevity, only the connection between box connector 12 and pin connector 16 will be described, it being understood that pin connector 18 and box connector 14 are structurally the same as pin connector 16 and box connector 12, respectively. Box connector 12 includes an axially inner, internally threaded section 20; an axially outer, internally threaded section 22; and a thread-free section 24 between the axially inner and axially outer threaded sections 20 and 22, respectively. Threaded sections 20 and 22 form a two-step thread, as is well known in the art. Pin connector 16 has an axially inner, externally threaded section 26; an axially outer, externally threaded section 28; and a thread-free section 30 therebetween. Threaded sections 20 and 22 in box connector 10 are complementary or mating to threaded sections 28 and 26, respectively, on pin connector 16. As described more fully hereinafter, torque shoulders on pin connector 16 and box connector 10 are engaged as shown at 32, there being annular reliefs 34 and 36 disposed on opposite axial sides of the engaged torque shoulders. Further, as will be described more fully hereinafter, there is at least one metal-to-metal seal formed between the thread-free sections of box connector 10 and pin connector 16, respectively.

Figure 2:
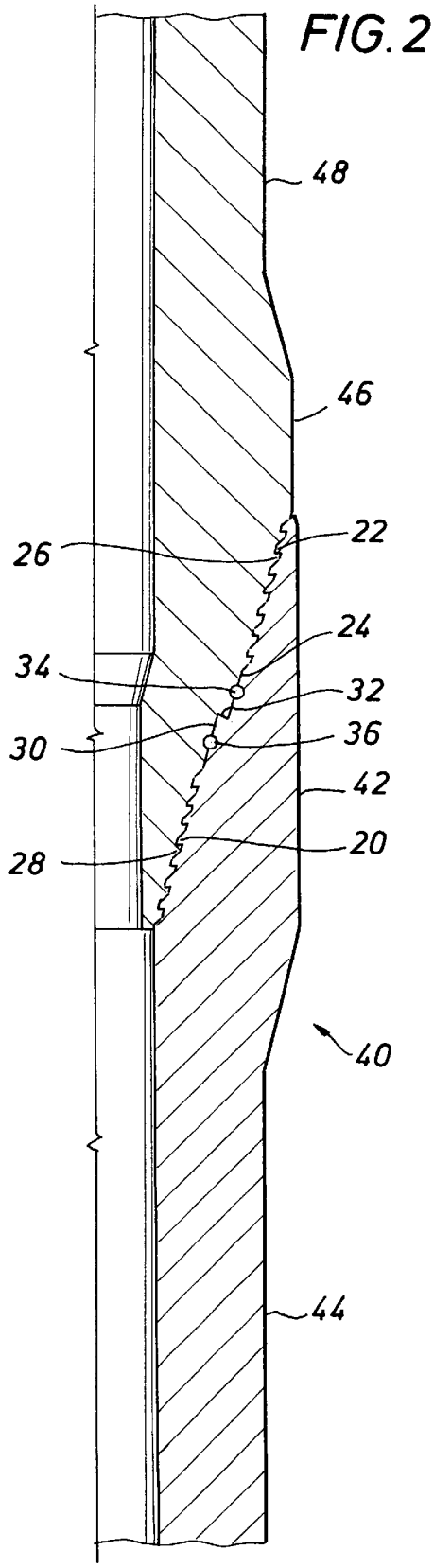
FIG. 2 is a quarter, cross-sectional view of another embodiment of the threaded connection of the present invention.

With reference now to FIG. 2, there is shown an integral threaded connection 40 comprised of a box connector 42 formed on an upset end of a pipe section 44 and a pin connector 46 formed as an upset end of a pipe section 48. Box connector 42 and pin connector 46 are in other respect identical to box connector 12 and pin connector 16, described above with respect to FIG. 1.

Figure 7:
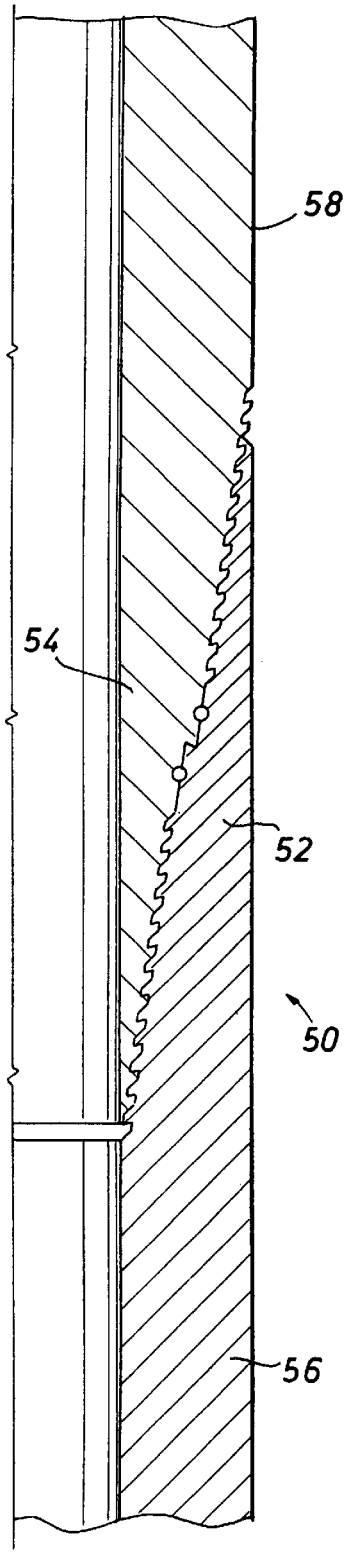
FIG. 7 is a quarter, cross-sectional view of another embodiment of the threaded connection of the present invention.

With reference now to FIG. 7, there is shown an integral threaded connection 50 comprising a box connector 52 and a pin connector 54, box connector 52 and pin connector 54 being formed on the ends of pipe sections 56 and 58, respectively. Threaded connection 50 is commonly referred to as a flush connection in that the OD of the box and pin connectors 52, 54 is the same as the OD of the pipe sections 56, 58, respectively. Engagement between box connector 52 and pin connector 54 is essentially as that described above with respect to threaded connection 10, shown in FIG. 1, and as will be more fully described hereinafter.

Figure 11:
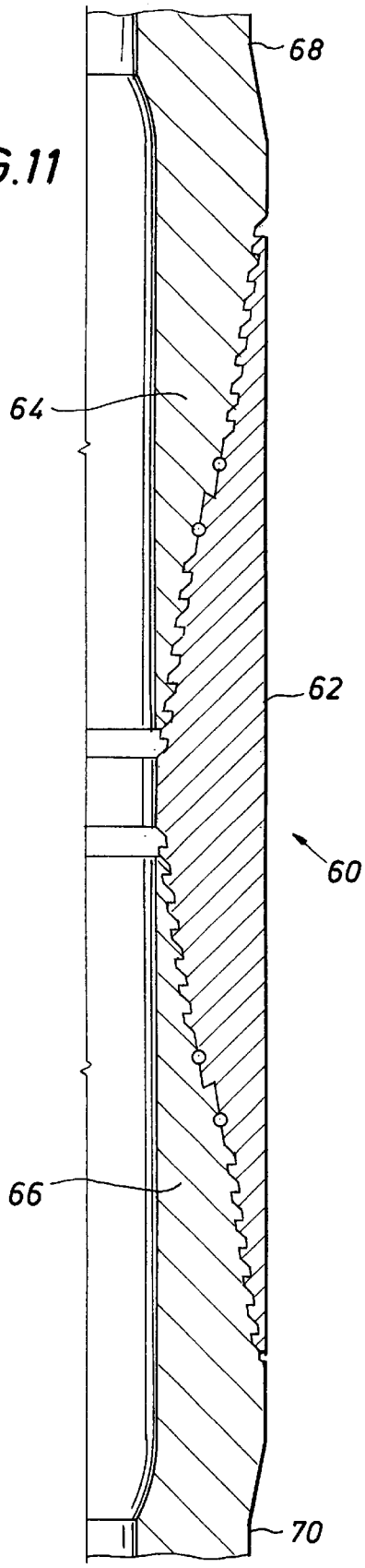
FIG. 11 is a quarter, cross-sectional view of another embodiment of the threaded connection of the present invention.

With reference now to FIG. 11, there is shown another threaded connection in accordance with the present invention. Connection 60, shown in FIG. 11, is similar to the threaded connection 10 in that it is a coupled connection. However, it differs from coupled threaded connection 10 primarily in that pin connectors 64 and 66 received in coupling 60 are formed by upsetting the ends of tubular connectors 68 and 70, respectively. However, the threaded engagement between coupling 62 and pin connectors 64 and 66 is essentially the same as that described with respect to threaded connection 10.

Figure 12:
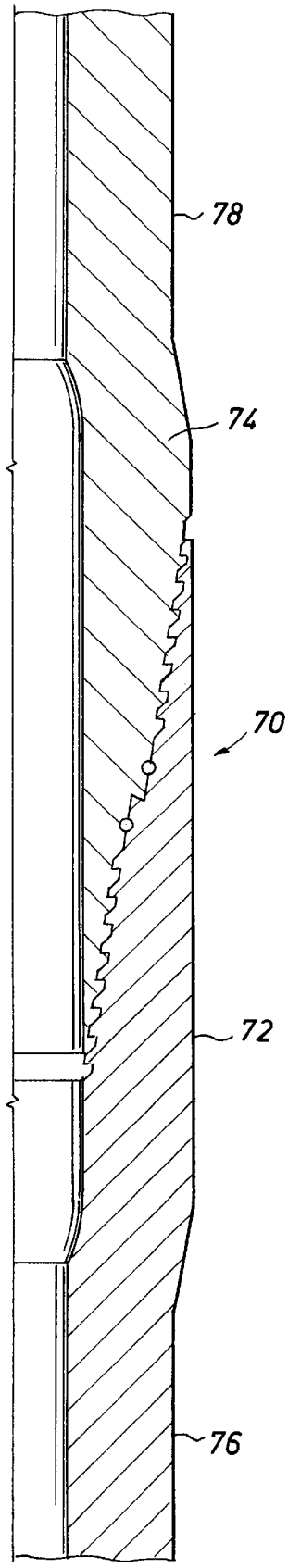
FIG. 12 is a quarter, cross-sectional view of another embodiment of the threaded connection of the present invention.

With reference now to FIG. 12, there is shown a threaded connection 70 that is similar to threaded connection 40, shown in FIG. 2; i.e., connection 70 is an integral joint connection and comprises a box connector 72 and a pin connector 74, box connector 72 being formed by upsetting the end of a tubular member or pipe section 76, pin connector 74 being formed on an upset end portion of tubular member or pipe section 78. In all other respects, the threaded engagement between box connector 72 and pin connector 74 is essentially the same as that described above with respect to threaded connection 40, shown in FIG. 2.

Figure 3:
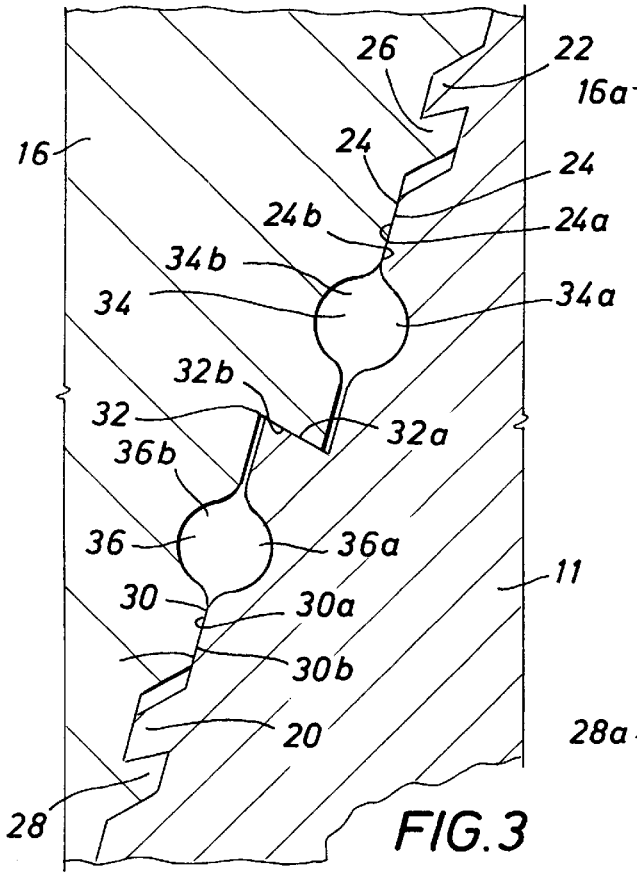
FIG. 3 is an enlarged cross-sectional view showing a center torque shoulder, two axially spaced metal-to-metal seals, and two axially spaced, annularly extending reliefs formed by registering grooves.

With reference now to FIG. 3, there is shown in greater detail substantially that portion of threaded connection 10 circumscribed by circle A in FIG. 1, it being understood that the detail shown in FIG. 3 would be applicable to the threaded connections 40, 50, 60, and 70, shown in FIGS. 2, 7, 11, and 12, respectively. As previously noted, box connector 12 formed in coupling 11 has a thread-free portion 24 that extends from axially outer, internally threaded section 22 to axially inner, internally threaded section 20, while pin connector 16 has a thread-free section 30 extending from axially inner, externally threaded section 26 to axially outer, externally threaded section 28. Box connector 12 has a torque shoulder 32*a*, while pin connector 16 has a torque shoulder 32*b*, both of which, in the embodiment shown in FIG. 3, are generally annular frustoconical parallel shoulders, the shoulders having pressure interfit and defining dovetails in axial, radial planes. The dovetail angularity may advantageously be positive as measured from a plane or planes normal to the axis of the threaded connection 10, the shoulders 32*a* and 32*b* thereby serving to block radial and axial separation of the box and pin connectors 12 and 16, respectively. Box connector 11 has a frustoconical thread-free surface 24*a* that is in metal-to-metal sealing engagement, as at 24, with the frustoconical surface 24*b* formed on pin connector 16 when torque shoulders 32*a* and 32*b* are engaged. A second metal-to-metal seal 30 is formed between frustoconical surfaces 30*a* in box connector 11 and frustoconical surface 30*b* on pin connector 16 when torque shoulders 32*a* and 32*b* are engaged. There is a first annular relief 34 formed by registering grooves 34*a* and 34*b* in box connector 11 and pin connector 16, respectively. There is also a second annular relief 36 formed by annular grooves 36*a* and 36*b* formed in box connector 11 and on pin connector 16, respectively. Reliefs 34 and 36 serve the dual purpose of being a reservoir for excess thread dope, which could build up and tend to separate metal-to-metal seals 24 and 30 and, in addition, impart flexibility to the threaded connection during any expansion process or when the threaded connection is subjected to high bending loads.

Figure 6:
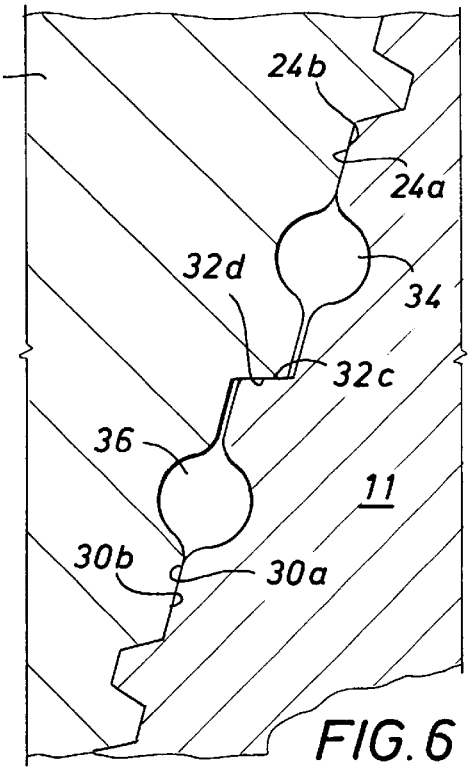
FIG. 6 is a view similar to FIG. 3, but showing only one metal-to-metal seal.

With reference now to FIG. 6, there is shown a variation of the configuration shown in FIG. 3 in that while torque shoulders 32*a* and 32*b* in FIG. 3 are dovetailed with a positive angularity, torque shoulders 32*c* and 32*d* formed in box connector 11 and pin connector 16, respectively, are substantially perpendicular to the axis of threaded connection 10.

Figure 4:
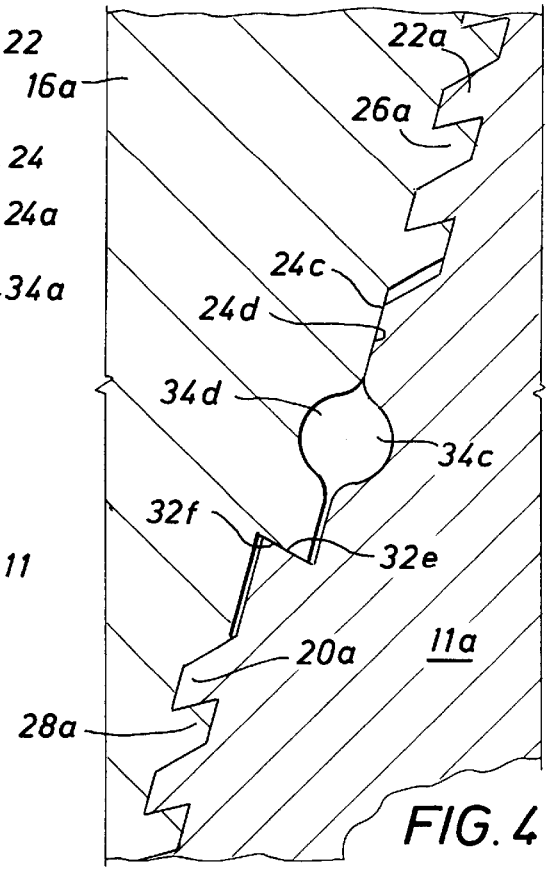
FIG. 4 is an enlarged cross-sectional view showing a center torque shoulder, one metal-to-metal seal, and one annularly extending relief formed by registering grooves.

With reference now to FIG. 4, there is shown another embodiment of the present invention that employs only a single metal-to-metal seal and a single annular relief. Box connector 11*a* has an axially inner, internally threaded section 20*a*, an axially outer, internally threaded section 22*a*, and a thread-free section between threaded sections 20*a* and 22*a*. As with the threaded connection described with reference to FIG. 3, there is a dovetail torque shoulder 32*e* formed in box connector 11*a* and a dovetail torque shoulder 32*f* formed on pin connector 16*a*. Box connector 11*a* has a frustoconical surface 24*c* that engages a frustoconical surface 24*d* on pin connector 16*a* in metal-to-metal sealing relationship and torque shoulders 32*e* and 32*f* are in engagement. An annular relief is formed by registering annular grooves 34*c* and 34*d* in box and pin connectors 11*a* and 16*a*, respectively. It will be appreciated that while the metal-to-metal sealing shown in the embodiment of FIG. 4 is axially outward of box connector 11*a* and axially inward of pin connector 16*a*, such metal-to-metal sealing could be accomplished as well by being axially inward of box connector 11*a* and axially outward of pin connector 16*a*. As with the embodiments described above, registering annular grooves 34*c* and 34*d* provide annular reliefs serving the dual purpose of providing a reservoir for thread dope that could act to separate the metal-to-metal sealing engagement between surfaces 24*c* and 24*d* when the connection is made up, as well as providing flexibility of the threaded connection during the expansion process or when the threaded connection is subjected to lateral loading.

Figure 5:
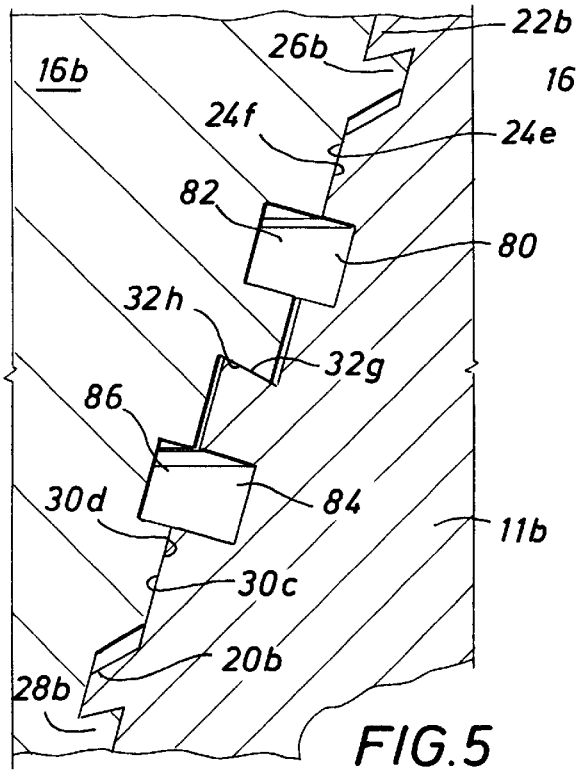
FIG. 5 is an enlarged cross-sectional view similar to FIG. 3, but showing the annular groove as being substantially rectangular in transverse cross-section.

With reference now to FIG. 5, there is shown yet another embodiment of the present invention wherein the annular relief, rather than being generally circular when viewed in transverse cross-section, is rectangular when viewed in transverse cross-section. Box connector Lid is provided with an axially inner threaded section 20*b*, an axially outer threaded section 22*b*, and a thread-free section therebetween. Pin connector 16*b* has an axially inner threaded section 26*b*, an axially outer threaded section 28*b*, and a thread-free section therebetween. Box connector 11*b* has a frustoconical surface 24*e* that is in metal-to-metal sealing engagement with a mating frustoconical surface 24*f* on pin connector 16*b* when torque shoulders 32*g* and 32*h* on box connectors 11*b* and pin connectors 16*b*, respectively, are engaged. In like manner, a second metal-to-metal seal is formed between frustoconical surfaces 30*c* in box connector lib and 30*d* on pin connector 16*b*. Box connector 11*b* has a generally rectangular, annularly extending groove 80 that is in register with an annularly extending rectangular groove 82 on pin connector 16*b*, forming an annular relief when torque shoulders 32*g* and 32*h* are engaged. Box connector 11*b* further has a second annularly extending rectangular groove 84 that is in register with an annularly extending rectangular groove 86 on pin connector 16*b*, forming a second annular relief when torque shoulders 32*g* and 32*h* are engaged. It is to be noted that the depth of the rectangular grooves 80, 82, 84 and 86 is varied such that the depth of the groove varies directly with the wall thickness of the connector in which it is formed. Thus, groove 80 is shallower than groove 82, and groove 86 is shallower than groove 84. Once again, the grooves serve as thread dope reservoirs and provide the connection with added flexibility, as described above.

Figure 8:
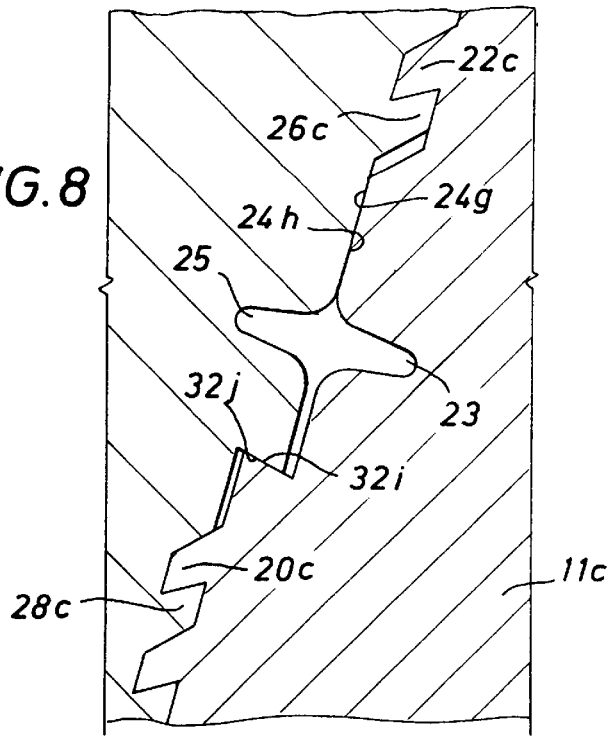
FIG. 8 is an enlarged, cross-sectional view similar to FIG. 6 but showing the use of deep annular grooves.

With reference now to FIG. 8, there is shown another embodiment of the threaded connection of the present invention. The threaded connection shown in FIG. 8 is similar to that shown in FIG. 4 in that there is only a single annular relief formed by mating grooves in the pin and box connectors. However, it differs from the embodiment in FIG. 4 in that the cross-sectional shape of the groove is different. With reference then to FIG. 8, box connector 11*c* has a first threaded section 22*c*, a second, axially spaced, threaded section 20*c*, and a thread-free section therebetween, while pin connector 16*c* has a first threaded section 26*c* and a second, axially spaced, threaded section 28*c*, a thread-free section being formed therebetween. As in the case of the embodiment shown in FIG. 4, a metal-to-metal seal is formed between frustoconical surfaces 24*g* and 24*h* when torque shoulders 32*i* and 32*j* are engaged. Box connector 11*c* has an annular groove 23, while pin connector 11*c* has an annular groove 25, grooves 23 and 25 being in register when torque shoulders 32*i* and 32*j* are engaged to form an annular relief. As compared with grooves 34*c* and 34*d*, shown in FIG. 4, it can be seen that grooves 23 and 25 have a much greater radial depth, albeit that they have a narrower axial width.

Figure 13:
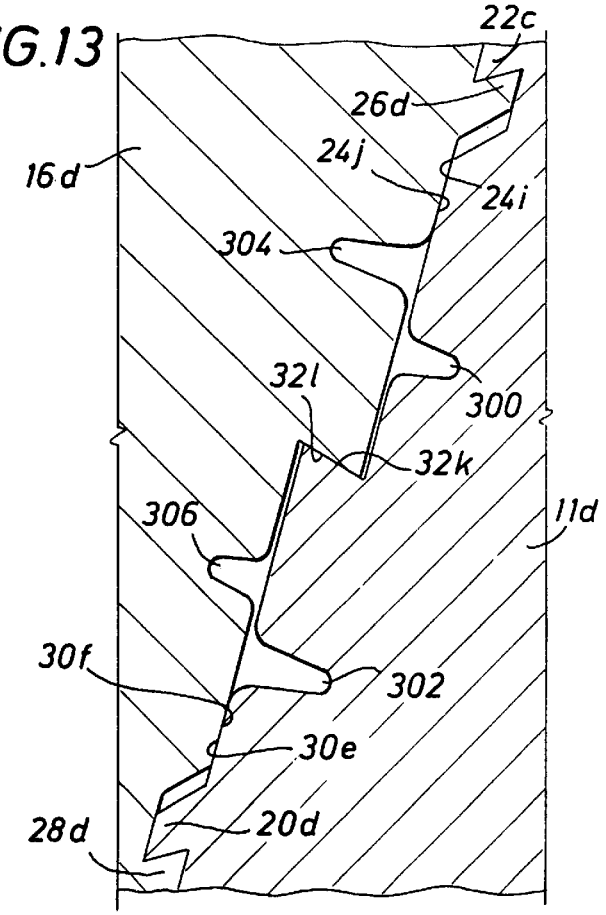
FIG. 13 is an enlarged cross-sectional view showing a center torque shoulder, two metal-to-metal seals and two, axially spaced annular reliefs between each of the metal-to-metal seals and the torque shoulder.

With reference now to FIG. 13, there is shown another embodiment of the threaded connection of the present invention. The threaded connection shown in FIG. 13 is similar in some respect to the threaded connection shown in FIG. 3 in that the pin and box connectors have their torque shoulders located in the thread-free portions of the pin and box connectors and there are two metal-to-metal seals, one being axially adjacent the axially innermost and axially outermost engaged threads of the pin and box connectors, respectively, the other metal-to-metal seal being adjacent the axially outermost and axially innermost engaged threads of the box and pin connectors, respectively. Box connector 11*d* has an axially inner threaded section 20*d*, an axially threaded outer section 22*c*, and a torque shoulder 32*k*. Pin connector 16*d* has an axially inner threaded section 26*d* that matingly engages threaded section 22*c* and an axially outer threaded section 28*d* that matingly engages threaded section 20*d*. Pin connector 16*d* further has a torque shoulder 32*l* engageable by torque shoulder 32*k* in box connector 11*d*. Pin and box connectors 11*d* and 16*d*, respectively, have two metal-to-metal seals formed at engaged frustoconical surfaces 24*i*, 24*j*, and 30*e*, 30*f*, respectively, when torque shoulders 32*k* and 32*l* are engaged. Pin connector 11*d* has a first annular groove 300 and an axially, inwardly spaced, second annular groove 302, while pin connector 16*d* has a first annular groove 304 and an axially, outwardly spaced, second annular groove 306. As can be seen, when box and pin connectors 11*d* and 16*d* are made up, as shown in FIG. 13, the grooves 300 and 302 on box connector 11*d* are not in register with grooves 304 and 306 on pin connector 16*d*. In this regard, note that groove 300 is axially displaced from groove 304, while groove 302 is axially displaced from groove 306. It is also to be observed that the depth of the grooves is proportional to the radial wall thickness of the section of the respective connectors in which they are formed. Thus, with respect to box connector 11*d*, groove 302, being at a thicker radial section of box connector 11*d*, has a deeper radial depth than groove 300. In like fashion, groove 304 and pin connector 16*d* has a deeper radial depth than groove 306.

Figure 9:
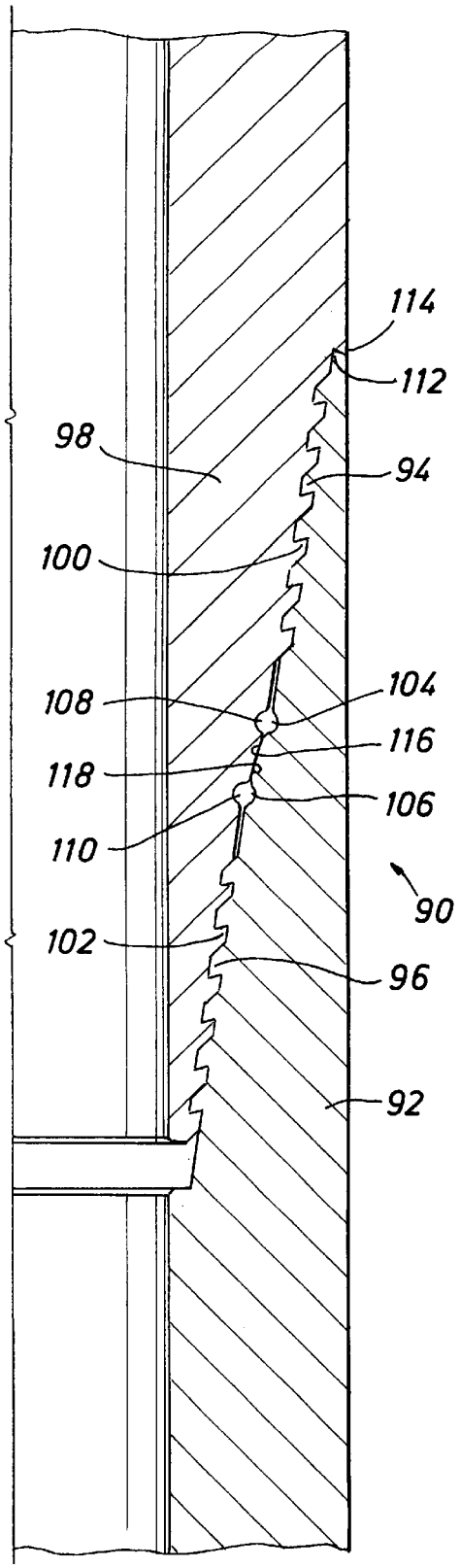
FIG. 9 is a quarter, cross-sectional view of another embodiment of the threaded connection of the present invention.
Figure 10:
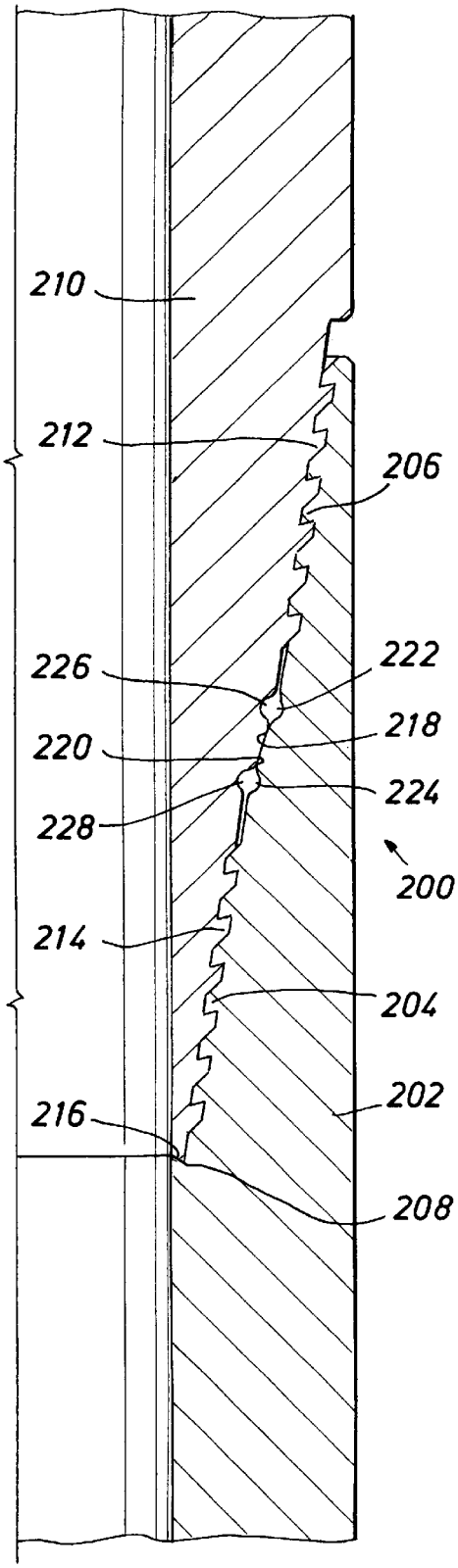
FIG. 10 is a quarter, cross-sectional view of another embodiment of the threaded connection of the present invention.

With reference now to FIGS. 9 and 10, there are shown alternate embodiments of the threaded connection of the present invention wherein the torque shoulders, rather than being disposed intermediate the axially inner and outer threaded sections, are located axially inward of the pin connector and outward of the box connector (FIG. 9), or axially outward of the pin connector and inward of the box connector (FIG. 10). With reference then to FIG. 9, a threaded connection 90 comprises a box connector 92 having an axially outer, internally threaded section 94, an axially inner, internally threaded section 96, and a thread-free portion therebetween, and a pin connector 98 having an axially inner, externally threaded section 100 and an axially outer, externally threaded section 102 with a thread-free portion therebetween. As in the cases described above, threaded sections 94 and 92 mate with threaded sections 100 and 102, respectively. Formed in the thread-free section between threaded sections 94 and 96 in box connector 92 is a first annular groove 104 and a second, axially spaced, annular groove 106. Formed on pin connector 98 is a first annular groove 108 and a second, axially spaced, annular groove 110. Box connector 92 has an axially facing, annularly extending torque shoulder 112, while pin connector 98 has an axially facing, annularly extending torque shoulder 114. Formed in the thread-free section between threaded sections 94 and 96 in box connector 92 is a frustoconical surface 116 that is in metal-to-metal sealing engagement with a frustoconical surface 118 formed on pin connector 98 between threaded sections 100 and 102. It will thus be seen that when torque shoulders 112 and 114 are in engagement, grooves 104 and 108 are in register, as are grooves 106 and 110, and surfaces 116 and 118 are in metal-to-metal sealing engagement.

With reference now to FIG. 10, the threaded connection 200 comprises a box connector 202 having an axially inner, internally threaded section 204; an axially outer, internally threaded section 206; and a thread-free section therebetween. Box connector 202 also has an axially facing, axially innermost torque shoulder 208. Pin connector 210 has an axially inner, externally threaded section 212; an axially outer, externally threaded section 214; and a thread-free section therebetween, pin connector 210 also having an axially facing, axially outermost torque shoulder 216. Pin connector 202 has a frustoconical surface 218 formed in the thread-free section between threaded sections 206 and 204, while pin connector 210 has a frustoconical surface 220 formed in the thread-free section between threaded sections 214 and 216. Formed in box connector 202 is a first annular groove 222 and a second annular groove 224, grooves 222 and 224 being axially spaced from one another. Formed on pin connector 210 is a first annular groove 226 and a second annular groove 228, grooves 226 and 228 likewise being axially spaced from one another. When box torque shoulder 208 and pin torque shoulder 216 are in engagement, grooves 222 and 226 are in register, and grooves 224 and 228 are in register to form annular reliefs, a metal-to-metal seal being formed between frustoconical surfaces 218 and 220.

An important feature of the threaded connection of the present invention is that the metal-to-metal sealing between the box and pin connector is concentrated generally midway of the connection and accordingly, at a point of enhanced radial thickness. This obviates the necessity of forming a metal-to-metal seal either at the axially innermost end of the box connector or the axially outermost end of the box connector and permits full thread runout; i.e., the threaded sections on the box and pin connectors can extend substantially to their axially innermost end and axially outermost end, respectively, thus maximizing the tension strength of the threaded connections of the present invention. It will be appreciated that there could be multiple metal-to-metal seals that could be disposed between multiple reliefs; i.e., there could be multiple axially spaced reliefs and multiple axially spaced metal-to-metal seals, at least some of the metal-to-metal seals being between annular reliefs.

Another feature of the present invention, ideal not only for expandible pipe strings, but any pipe strings that are subject to lateral loading or bending, is that the flexibility of the connections can be tailored using the annular reliefs. For example, one can balance the flexibility of the box connector and the pin connector by proper selection of the size, e.g., depth and width of the grooves, their shape, and their location. By way of example and with reference to FIG. 13, staggering the grooves rather than having them registering, as well as varying their radial depth, provides a greater axial length over which the enhanced flexibility imparted by the reliefs is spread. Indeed, it will be appreciated that there are virtually endless possibilities with respect to relief size, location, and number in the thread-free portions between the axially inner and axially outer threaded sections of the box and pin connectors.

As will also be appreciated, and as shown particularly in FIGS. 9 and 10, shoulder engagement between the torque shoulders need not occur in the thread-free portions of the box and pin connectors, but rather can occur axially innermost of the box connector (FIG. 10) or axially outermost of the box connector (FIG. 9), further allowing the threaded connection to be tailored for specific applications.

While the invention has been described, as shown in the drawings, with respect to tapered threaded sections, it will be understood that it is not so limited. For example, the threads can be straight rather than tapered, as shown, for example, in U.S. Pat. No. 4,192,533, incorporated hereinby reference for all purposes. Furthermore, virtually any thread-form can be employed, including so-called hook threads or wedge threads, hook threads being commonly referred to as semi-dovetail, wedge threads being commonly referred to as dovetail. The threaded connections of the present invention could also employ multiple starting threads for quick makeup.

The foregoing description and examples illustrate selected embodiments of the present invention. In light thereof, variations and modifications will be suggested to one skilled in the art, all of which are in the spirit and purview of this invention.

What is claimed is:

1. A threaded connection for tubular members, comprising:

a box connector having an axially inner, internally threaded section, an axially outer, internally threaded section, and a thread-free section between said inner and outer internally threaded sections, said axially inner and axially outer threaded sections defining a two-step thread;

a pin connector having an axially inner, externally threaded section, an axially outer, externally threaded section, and a thread-free section between said inner and outer externally threaded sections, said threads in said box connector mating with said threads on said pin connector;

at least one annular relief in at least one of said thread-free portions of said pin connector and said box connector;

an axially facing, annularly extending pin torque shoulder on said pin connector;

an axially facing, annularly extending box torque shoulder in said box connector; and a metal-to-metal seal being formed between at least a portion of said thread-free portions of said box connector and said pin connector when said pin torque shoulder and said box torque shoulder are engaged, said one annular relief being disposed between said metal-to-metal seal and said torque shoulder.

2. The threaded connection of claim 1 wherein said box connector comprises a coupling having first and second, axially spaced box connectors.

3. The threaded connection of claim 1 wherein there is a first annular groove in said thread-free section of said box connector and a second annular groove in said thread-free section of said pin connector, said first and second grooves being in register to form a first relief when said pin torque shoulder and said box torque shoulder are engaged.

4. The threaded connection of claim 3 wherein there is a third annular groove in said thread-free section of said box connector, said third annular groove being axially spaced from said first annular groove and a fourth annular groove on said thread-free section of said pin connector, said fourth annular groove being axially spaced from said second annular groove, said third and fourth annular grooves being in register to form a second annular relief when said pin torque shoulder and said box torque shoulder are engaged, said second annular relief being disposed between said metal-to-metal to seal and said torque shoulder.

5. The threaded connection of claim 3 wherein said thread-free section in said box connector forms a first frustoconical surface and said thread-free section on said pin connector forms a second frustoconical surface complementary to said first frustoconical surface, said first and second frustoconical surfaces forming said metal-co-metal seal when said pin torque shoulder and said box torque shoulder are engaged.

6. The threaded connection of claim 3 wherein said first and second annular grooves have different depths.

7. The threaded connection of claim 4 wherein there is a first metal-to-metal seal between said registering first and second grooves and said axially outer internally threaded section in said box connector and said axially inner, externally threaded section on said pin connector and a second metal-to-metal seal between said registering third and fourth grooves and said axially inner, internally threaded section in said box connector and said axially outer, externally threaded section on said pin connector.

8. The threaded connection of claim 4 wherein said metal-to-metal seal is between said first relief and said axially outer, internally threaded section in said box connector and said axially inner, externally threaded section on said pin connector.

9. The threaded connection of claim 4 wherein said first and second annular grooves have different depths and said third and fourth annular grooves have different depths.

10. The threaded connection of claim 1 wherein said box and pin torque shoulders define dovetails in axial, radial planes, the angularity of said dovetail being positive as measured from planes normal to an axis passing through said threaded connection.

11. The threaded connection of claim 1 wherein said box and pin shoulders are substantially perpendicular to an axis passing through said threaded connection.

12. The threaded connection of claim 1 wherein said box torque shoulder is formed axially outwardly of said axially outer, internally threaded section and said pin shoulder is formed axially inward of said axially inner, externally threaded section.

13. The threaded connection of claim 1 wherein said box torque shoulder is formed axially inwardly of said axially inner, internally threaded section and said pin shoulder is formed axially outwardly of said axially outer, externally threaded section.

14. The threaded connection of claim 1 wherein said box connector and said pin connector have substantially the same outside diameter and substantially the same inside diameter.

15. The threaded connection of claim 1 wherein when said pin torque shoulder and said box torque shoulder are engaged, there is a first metal-to-metal seal axially spaced in a first axial direction from said engaged torque shoulder and a second metal-to-metal seal axially spaced in a second axial direction from said engaged torque shoulder.

16. The threaded connection of claim 15 wherein there is a first annular relief between said first metal-to-metal seal and said engaged torque shoulder and a second annular relief between said second metal-to-metal seal and said engaged torque shoulder.

17. The threaded connection of claim 16 wherein there is a first annular groove in said thread-free section of said box connector and a second annular groove in said thread-free section of said pin connector, said first and second annular grooves being disposed between said first metal-to-metal seal and said engaged torque shoulder and there is a third annular groove in said thread-free section of said box connector and a fourth annular groove in said thread-free section of said pin connector, said third and fourth annular grooves being disposed between said second metal-to-metal seal and said engaged torque shoulders.

18. The threaded connection of claim 17 wherein at least one pair of said first and second grooves and said third and fourth grooves, respectively, are in register.

19. The threaded connection of claim 17 wherein said first and second annular grooves are axially displaced from one another and said third and fourth annular grooves are axially displaced from one another.

20. The threaded connection of claim 18 wherein said first and second annular grooves have different depths.

21. The threaded connection of claim 20 wherein said third and fourth annular grooves have different depths.

22. The threaded connection of claim 4 wherein said thread-free section in said box connector forms a first frustoconical surface and said thread-free section on said pin connector forms a second frustoconical surface complementary to said first frustoconical surface, said metal-to-metal seal being formed between said first and second frustocanical surfaces when said pin torque shoulder and said box torque shoulder are engaged, said metal-to-metal seal being between said first and second registering grooves and said third and fourth registering grooves.

* * * * *